United States Patent [19]

Crewse

[11] 4,154,495

[45] May 15, 1979

[54] SECUREMENT CLIP FOR ELECTRICAL RECEPTACLES HAVING HINGED COVER PLATES

[75] Inventor: John L. Crewse, Parma Heights, Ohio

[73] Assignee: Samuel Moore and Company, Aurora, Ohio

[21] Appl. No.: 845,657

[22] Filed: Oct. 26, 1977

[51] Int. Cl.[2] ..... H01R 13/54

[52] U.S. Cl. ..... 339/75 P; 339/10

[58] Field of Search ..... 339/10, 75 P, 44 R

[56] References Cited

U.S. PATENT DOCUMENTS 2,158,385 5/1939 Schwien ..... 339/44 R X

*Primary Examiner*—Roy Lake
*Assistant Examiner*—E. F. Desmond
*Attorney, Agent, or Firm*—Stevens, Davis, Miller & Mosher

[57] ABSTRACT

A clip for securing a detachable electrical plug and cable assembly in an electrical receptacle having a hinged cover plate. The clip has first and second body members; means for securement of the first body member to the electrical plug and cable assembly; means for rotatably attaching the second body member relative the first body member; and biasing means integral with the first or second body members for pressing an adapted end of the second body member against the outside suface of the cover plate and bias the cover towards a closed position such that at least a portion of the inside surface of the cover plate presses against the plug to secure the electrical plug and cable assembly against relative movement with the receptacle. The first and second body members of the clip are preferably made from metallic wire or plate, but may be made from polymeric materials or combinations of polymeric and metallic materials. The clip is particularly useful in securing an electrical plug and cable assembly against relative movement with electrical receptacles used in Vehicle Tractor-Trailer applications.

9 Claims, 18 Drawing Figures

FIG. 6A
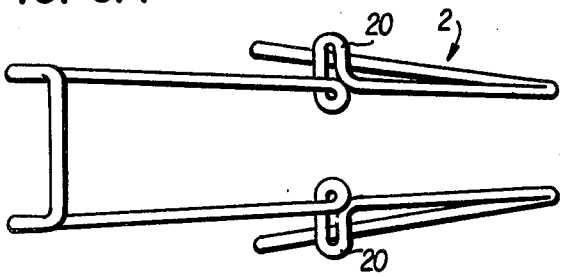
FIG. 6B
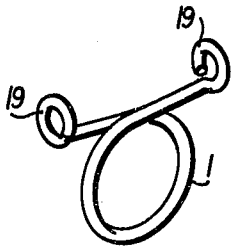
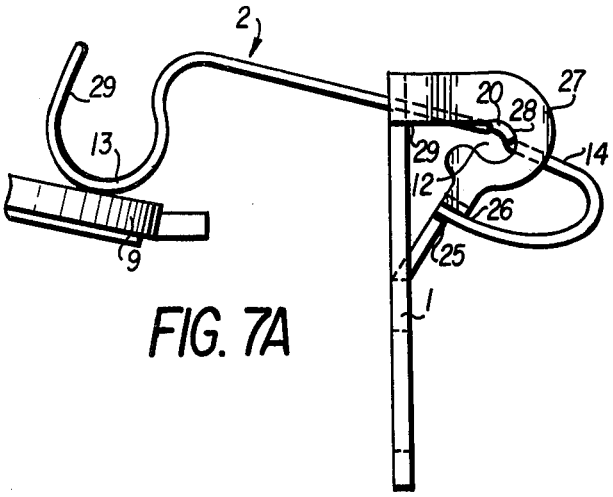
FIG. 7A
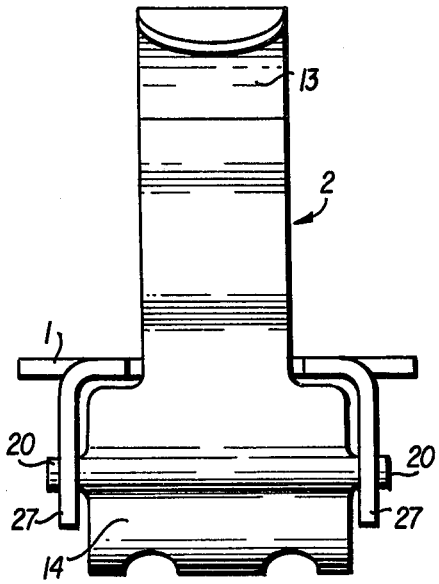
FIG. 7B
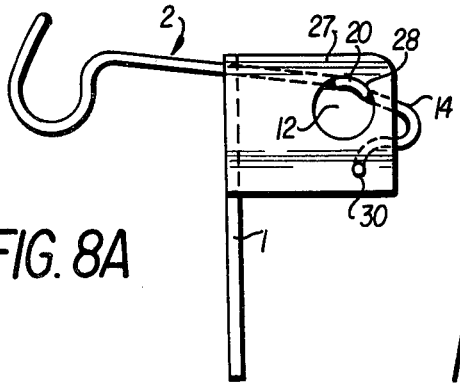
FIG. 8A
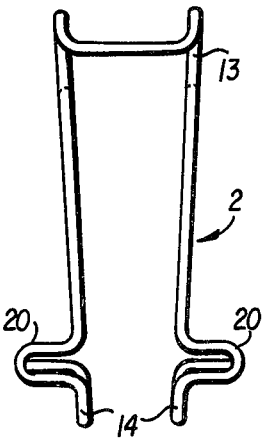
FIG. 8B

SECUREMENT CLIP FOR ELECTRICAL RECEPTACLES HAVING HINGED COVER PLATES

This invention relates generally to a electrical plug and cable assembly electrically inter-connected with an electrical receptacle having a hinged cover plate and more particularly to such an assembly provided with means for securing the assembly against relative movement with the receptacle.

BACKGROUND OF THE INVENTION

Electrical receptacles having hinged cover plates are commonly used in applications where it is desirable to protect the components contained therein against corrosion or damaging environments. Generally, the cover plate is designed such that it automatically closes to seal off the exposed end of the receptacle when it is not being used in making an electrical connection with an electrical plug and cable assembly. One method commonly used to close such receptacle covers is to incorporate a Torsion spring as part of the hinging mechanism.

More particularly, certain electrical receptacle cover plates are provided with a means on the inner surface thereof for interlocking with the plug when the plug is inserted in the receptacle to secure the plug and cable assembly in the receptacle. One such receptacle features a protuberance extending from the inner surface of the cover such that when the plug is inserted into the receptacle the Torsional action of spring forming part of the cover plate hinge biases the inside surface of the cover plate against the plug such that the protuberance is disposed between the end of the plug and a raised surface on the plug such that it interlocks the plug and cable assembly with the cover plate and secures it to the receptacle as long as the Torsional biasing means of the cover plate remains intact or produces the force necessary to maintain such interlocking. Electrical receptacles with hinged cover plates having a protuberance on their inner surface for interlocking and securement of plug and electrical cable assemblies to the receptacle are, used, for example, to provide detachable electrical connections between Tractor-Trailer Vehicles. The receptacle is usually mounted on the front panel of the Trailer and the plug and cable assembly is electrically connected to the end of an electrical cable carrying current from the Tractor to the Trailer. Such installations particularly require attention to the condition of the cover plates ability to maintain the required force to interlock with the plug as hereinbefore mentioned since in many cases the weight of the electrical cable may create a force tending to pull the plug and cable assembly away from the receptacle; the torsional springs normally used to bias such cover plates against the plug may become weakened from use and/or corrosional effects; or vibrational forces may tend to disengage the connection. The use of coiled retractable electrical cables between Tractor-Trailer Vehicles has recently increased. Such coiled, retractile-type electrical cables, by design, result in an increased axial force tending to separate the plug from the receptacle then heretofore caused by the weight alone associated with non-retractile type electrical cables and thereby further increase the need of providing a means of securing the plug and electrical cable assembly against relative movement with the electrical receptacle. The novel clip of the present invention provides a low cost means of improving the means of securing a plug and electrical cable assembly in a receptacle having a hinged cover plate and in some cases extending the useful life of the cover plate.

Plug and receptacle assemblies of the type contemplated by this invention are known and are being used by the Trucking Industry. Examples of such assemblies are disclosed for example in U.S. Pat. Nos. 3,284,753, 3,887,256 and 3,915,476.

A device for securing a plug and electrical cable assembly in an electrical receptacle having a cover plate is disclosed, for example, in U.S. Pat. No. 2,158,385 in which a complex reaction arm and compression spring arrangement is used to bias the socket cover against the plug and to automatically disengage the plug from the socket when a Trailer is separated from its Tractor. The clip of the present invention comprises a simple, low cost means of improving securement of the type hereinbefore noted and does not require a great number of parts or an external compression spring to suitably provide such securement.

A one-piece clip addressed to similar subject matter is disclosed in U.S. Pat. application Ser. No. 668,263 filed Mar. 18, 1976, and assigned to the assignee of the present invention. Although suitable in certain applications, it has been found that the one-piece clip has dimensional limitations which preclude its use with a variety of electrical plug - receptacle assemblies in that it does not properly impinge upon the outer surface of the cover plate. The rotatable nature of the clip of the present invention and the integral means associated therewith of biasing the cover plate towards a closed position permit a more versatile use hereuntofore unknown to the art.

SUMMARY OF THE INVENTION

It is an object of this invention to provide an improved electrical plug and electrical receptacle assembly. Another object is to provide an improved electrical connection between an electrical plug and cable assembly with an electrical receptacle having a hinged cover plate. A further object is to provide an improved means of biasing the cover plate of an electrical receptacle such that the inner surface thereof presses upon an electrical plug inserted in the receptacle and restricts relative movement between the electrical plug and cable assembly and the receptacle. A still further object is to provide an improved clip having integral biasing means for pressing the cover plate of an electrical receptacle such that a protuberance extending from the inner surface of the cover interlocks with a raised portion of the plug to secure the electrical plug and cable assembly against relative axial movement with the receptacle.

BRIEF DESCRIPTION OF THE DRAWINGS

Other objects will become apparant from the following description with reference to the accompanying drawing in which:

FIG. 6 is, in A thereof, a plane elevation of an embodiment of the second body member of the clip of the invention and, in B thereof, is a perspective view of an embodiment of the first body member of the clip of the invention;

FIG. 7 is a fragmentary side elevation of an embodiment of the clip of the invention, in A thereof, and in B thereof, is a plane elevation of the clip illustrated in A;

FIG. 8 is a side elevation of an embodiment of the clip of the invention in A thereof, and in B thereof, is a plane elevation of the second body member of the clip of A;

DESCRIPTION OF THE PREFERRED EMBODIMENTS

The foregoing objects and others are accomplished in accordance with this invention generally speaking by providing an improved clip having integral means for biasing hinged cover plates of electrical receptacles having electrical plug and cable assemblies in electrical contact therewith such that the plate is pressed against the plug to secure the plug and cable assembly from relative movement therewith. The improved clip of the invention has first and second body members; means for securement of the first body member to the electrical plug and cable assembly; means for rotatably attaching the second body member to the first body member; one end of the second body member adapted to press against the outside surface of the cover plate; and means integral with the first or second body members for biasing the adapted end of the second body member against the outside surface of the cover plate and press the cover against the plug. In a preferred embodiment of the invention both the first and second body members are formed from a wire; the first body member is secured to the electrical plug and cable assembly by means of a compression force acting radially inwardly against the electrical plug and cable assembly; and the end of the second body member opposite the adapted end is shaped such that a portion thereof presses upon a fixed surface to provide the integral biasing means required to bias the adapted end thereof against the outside surface of the receptacle cover plate.

Figure 1:
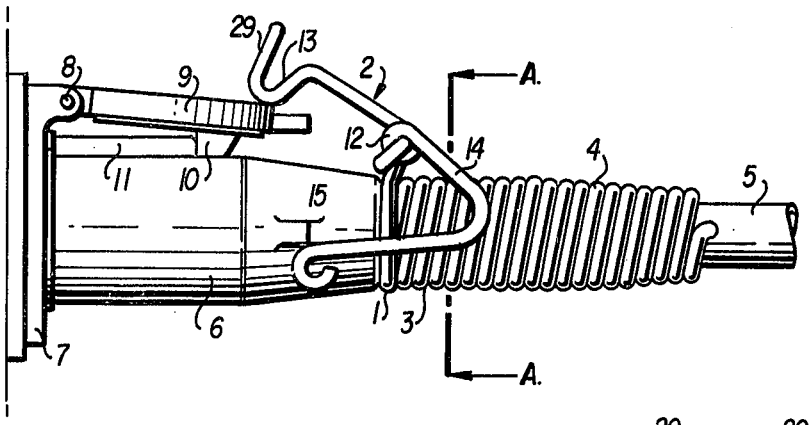
FIG. 1 is a side elevation showing an embodiment of the clip of the invention secured to an electrical plug and cable assembly inserted in the end of an electrical receptacle having a hinged cover plate.

FIG. 1 shows an embodiment of the clip of the invention having first body member 1 and second body member 2 respectively. Body member 1 is disposed about armour 4 adjacent the end of plug 6 and is secured to electrical cable and plug assembly 3 by exerting a radially inward compression force against the outside surface of armour 4. Armour 4 is disposed in encompassing relationship about the end of electrical cable 5 adjacent the end of electrical plug 6. Electrical plug 6 is inserted in the end of electrical receptacle 7 having hinge 8 biasing cover plate 9 towards a closed position such as, for example, by means of a torsion spring (not shown) such that a portion of the inner surface of cover plate 9 presses against the outside surface of plug 6. Electrical cable 5; electrical plug 6; and electrical receptacle 7 are electrically interconnected so as, for example, to provide electrical current between a Trailer Vehicle and a Tractor. In the embodiment shown in FIG. 1, protuberance 10 extends from the inner surface of plate 9 such that it is disposed between the end of plug 6 and the end of raised surface 11 disposed on plug 6 facing away from receptacle 7 to interlock plug 6 with receptacle 7. In the embodiment shown in FIG. 1, both body members 1 and 2 are made from a wire. Body member 2 has end 13 generally extending away from point 12 towards receptacle 7. Point 12 as hereinafter used, is defined as the location of rotatable attachment means between body member 1 and 2 and is preferably located on the side of plug 6 towards which cover 9 is biased towards. End 13 is shaped such that it is adapted to press upon the outer surface of cover 9 and bias cover 9 towards a closed position so that a portion of the inner surface thereof presses against plug 6 to restrict axial movement between electrical plug and cable assembly 3 and electrical receptacle 7. Opposite end 14 of body member 2 generally extends from rotatable attachment point 12 away from receptacle 7 and is shaped such that a portion thereof presses upon fixed surface 15 extending from plug 6. In the embodiment shown, fixed surface 15 is an exposed surface of plug 6 disposed on the side thereof, and has a surface substantially parallel with the longitudinal axis of electrical plug and cable assembly 3. In the embodiment shown in FIG. 1, movement of cover 9 towards an open position would cause its outer surface to press against adapted end 13 and rotate end 13 about rotatable attachment point 12 to cause opposite end 14 of body member 2 to press against fixed surface 15 and as a result thereof resist the movement of opposite end 14 causing opposite end 14 to resist rotation about point 12 and bias adapted end 13 against the outer surface of cover plate 9 to provide the integral means of biasing it towards a closed position to restrict axial movement between receptacle 7 and electrical plug and cable assembly 3. Electrical plug and cable assembly 3 of FIG. 1 is of a type that is generally cylindrical and symmetrical in its parts. Duplicate parts of plug 6 are disposed diametrically opposite (not shown) to those shown in FIG. 6 and, for the embodiment shown in FIG. 1, a pair of spaced apart opposite ends 14 are used.

Figure 2:
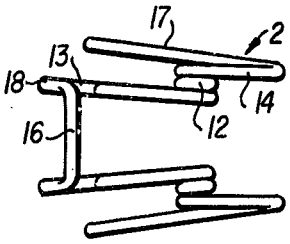
FIG. 2 is a plane elevation showing the general U shaped form of the secured body member of the clip of FIG. 1.

The embodiment of the clip of FIG. 1 is shown in FIG. 2 referenced to a plane substantially parallel to the longitudinal axis of generally U shaped form in the view of FIG. 2. Shown in FIG. 2, is adapted end 13 extending generally away from totatable attachment point 12 towards the electrical receptacle (not shown) and opposite ends 14 extend from point 12 in a direction generally away from the receptacle. In the embodiment shown, adapted end 13 is closed at its end to provide end 16 and spaced apart legs 17 of opposite end 14 extend to their respective ends such that opening 18 is provided therebetween. Body member 2 is looped at point 12 to provide a means of rotatable attachment to body member 1.

Figure 3:
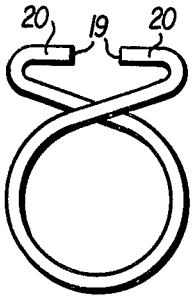
FIG. 3 is a view taken along plane A—A of the first body member of the clip of FIG. 1.

FIG. 3 shows an axial view of body member 1 comprising part of the clip embodiment shown in FIG. 1. Body member 1 is made from a resilient material and has opening 21 disposed at one end thereof for securement to an electrical plug and cable assembly. Opening 21 is sized such that it is caused to expand when it is disposed about the end of an electrical plug and cable assembly adjacent to the end of the plug and is secured thereto by the radial inward compression force resisting such expansion. The opposite end of body member 1 has ends 19 shaped such they are axially aligned and face each other to form shafts 20. Shafts 20 are generally transverse to the longitudinal axis of the electrical plug and cable assembly when body member 1 is secured thereto. In the embodiment shown in FIG. 2, the space between facing ends 19 should be sufficient such that, for example, body member 2 of FIG. 2 can be squeezed together such that the loops thereof, located at point 12, can be inserted within the space and upon release expand such that a portion of shafts 20 extend through the opening in the loops to form a rotatable attachment with body member 1.

Figure 4A:
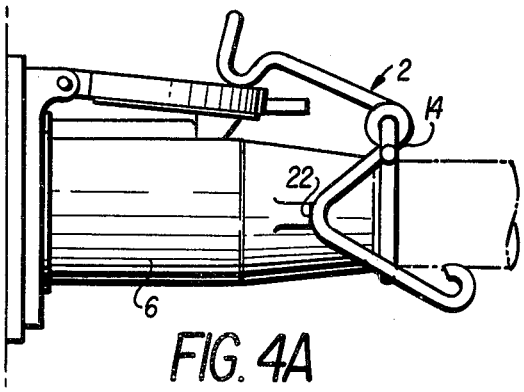
FIG. 4 is a fragmentary plane elevation illustrating in A and B thereof two embodiments of the second body member of the clip of the invention pressing upon a fixed surface.
Figure 4B:
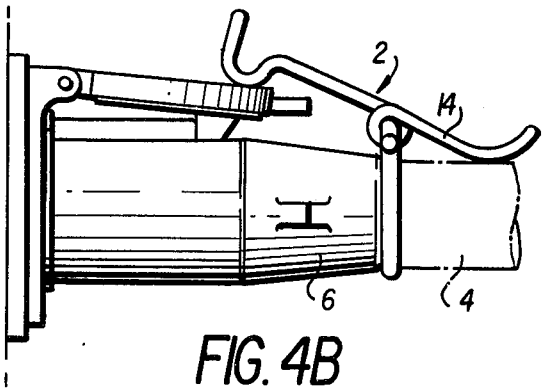

FIGS. 4A and 4B show the clip embodiment of FIG. 1 having the opposite end 14 thereof shaped to press upon various fixed surfaces. FIG. 4A illustrates an embodiment wherein opposite end 14 of body member 2 presses upon fixed surface 22. Surface 22 is an exposed surface of plug 6 facing away from the electrical receptacle. FIG. 4B shows an embodiment where opposite end 14 is shaped such that it presses upon electrical cable 5 adjacent the end of plug 6 such as, for example, at portion 23 to provide the fixed surface required for this form of the invention.

The examples of fixed surfaces shown in FIGS. 1, 4A and 4B are for illustrative purposes only in that any exposed surface of the plug and cable assembly or receptacle for which opposite end 14 can be shaped such that a portion thereof presses upon the surface and provides the biasing force required would be suitable for this form of the invention.

Figure 5A:
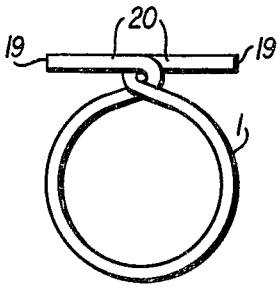
FIG. 5 is a view taken along the longitudinal axis of the electrical plug and cable assembly illustrating in A, B, C and D, thereof, embodiments of the first body member of the clip of the invention.
Figure 5B:
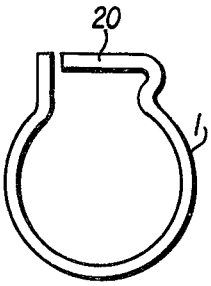
Figure 5C:
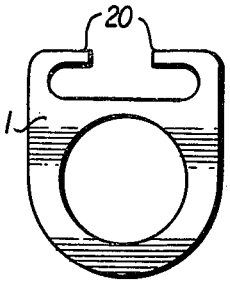
Figure 5D:
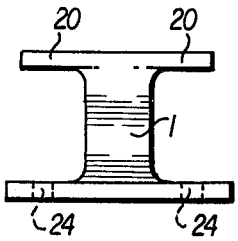

FIG. 5A illustrates an embodiment of body member 1 made from a resilient wire wherein ends 19 thereof are shaped such that they face away from each other to form substantially axially aligned shafts 20 for rotational attachment to body member 2. FIG. 5B illustrates where only one end of body member 1 may be shaped to form shaft 20 for rotational attachment to body member 2. FIG. 5C illustrates where body member 1 may be in the form of a plate to provide shafts 20 disposed at one end thereof for rotatable attachment to body member 2. FIG. 5D illustrates an embodiment wherein body member 1 may be shaped such that the securement end thereof is provided with holes 24 for securing body member 1 to an electrical plug and cable assembly which would lend itself to such type of securement. Also shown in FIG. 5D, are shafts 20 disposed at the opposite end of body member 1 for rotatable attachment to body member 2. Such embodiments are for illustrative purposes only, since enumerable shapes can be made to secure one end of body member 1 to an electrical plug and cable assembly and provide at the opposite end thereof axial aligned means disposed substantially transverse to the longitudinal axis of the electrical plug and cable assembly to provide suitable rotational attachment with body member 2.

FIG. 6A illustrates an embodiment wherein shafts 20 are formed from folding and compressing dimetrically opposite portions of body member 2 such that they are axially aligned and the ends thereof face away from each other. FIG. 6B shows an embodiment wherein ends 19 of body member 1 may be looped to form a pair of spaced apart axial aligned openings to provide a means of rotatable attachment to body member 2.

The openings formed by looping ends 19 shown in FIG. 6B are suitably shaped such that shafts 20 as, for example, shown in FIG. 6A would be substantially transverse to the longitudinal axis or an electrical plug and cable assembly when body member 1 is secured thereto. The embodiments shown in FIG. 6A and 6B are for illustrative purpose only. It is to be understood that the shaft forming part of the rotatable attachment means within the scope of this invention may be disposed either on body member 1 or on body member 2. Likewise, the opening through which the shaft is inserted would be disposed in the body member not having the shaft.

FIG. 7A illustrates an embodiment of the invention wherein body member 1 is provided with integral means for interlocking opposite end 14 of body member 2 to restrict the movement thereof and bias adapted end 13 against cover plate 9. In the embodiment shown in FIG. 7A, the means for interlocking opposite end 14 of body member 2 is a restricting means spaced apart from the rotatable attachment means disposed at point 12. In the example shown in FIG. 7A, the restricting means is provided by the space between end 25 of a protuberance extending from body member 1 and opposed facing surface 26 extending from flange 27. In the embodiment shown in FIG. 7A, flange 27 is substantially parallel to the longitudinal axis of the electrical plug and cable assembly and has an opposing facing flange spaced therefrom (not shown) such that the openings disposed therein at point 12 are substantially axially aligned and have a central longitudinal axis therebetween that is substantially transverse to the electrical plug and cable assembly longitudinal axis. Although flange 27 is shown in FIG. 7A as extending from body member 1 in a direction away from the receptacle, it is to be understood that it may also extent towards the receptacle if so desired. In the embodiment shown in FIG. 7A, surface 26 is formed from a protuberance extending from flange 27 such that it faces surface 25 to provide the said space. The end of opposite end 14 is inserted in the space between surfaces 25 and 26 and the width of the space is such that the movement of the end of opposite end 14 is restricted therein and bears upon one or both surfaces 25 and 26. Opposite end 14 is shaped such that shaft 20, extending from body member 2, is pressed against the wall of the opening at portion 28 and interlocks body member 2 with body member 1. In the embodiment shown, in FIG. 7A, movement of adapted end 13 of body member 2 away from cover 9, causes shaft 20 to further press against the wall of the opening and the resultant frictional force resists rotation of shaft 20 in the opening and biases adapted end 13 against cover plate 9 to move it towards a closed position. Also shown in FIG. 7A and FIG. 1, is end portion 29 of adapted end 13 of body member 2. Portion 29 extends from body member 2 in such a manner as to provide a means for lifting adapted end 13 away from cover plate 9 so that cover plate 9 may be moved towards an open position to remove the electrical plug and cable assembly from the electrical receptacle. Opposite 14 may also be shaped (not shown) such that pressing a portion thereof radially inward towards the electrical plug and cable assembly causes a portion of adapted end 13 to bear upon surface 29 extending between flanges 27 such that it is caused to pivot about the surface resulting in adapted end 13 moving away from cover 9 such that cover 9 may be moved towards an open position. FIG. 7B is a view of body member 2 of the clip embodiment as shown in FIG. 7A. Body member 2 is in the form of a plate having substantially axially aligned rotatable attachment means in the form of shafts 20 extending therefrom disposed between adapted end 13 and opposite end 14 thereof. Also shown in FIG. 7B, are spaced apart flanges 27 providing the integral means of interlocking body member 2 with body member 1 as hereinbefore described.

FIG. 8A shown an embodiment where the restricting means of interlocking body member 2 with body member 1 is provided by opening 30 in flange 27 spaced apart from the rotatable attachment means disposed at point 12. Opposite end 14 is shaped such that shaft 20 extends from body member 2 through the opening at point 12 in flange 27 and presses, for example, at portion 28 of the opening wall. FIG. 8B shows a view of body member 2 used in FIG. 8A. Oppositely facing axially aligned shafts 20 extend from body member 2 and are provided by forming the wire of which body member 2 is made. The ends of opposite end 14 are shaped such that they can be inserted in opening 30 shown in FIG. 8A. FIG. 8B shows body member 2 as being generally symmetrical having spaced apart legs forming opposite end 14. An axially aligned opening providing point 12 is disposed in a flange 27 (not shown) spaced apart from flange 27 shown in FIG. 8A such that body member 2 shown in FIG. 8B can be suitably inserted therebetween and provide the rotatable attachment relationship between body members 1 and 2. Although it is preferred that that clip of this invention have a symmetrical form having a pair of axially aligned shafts extending from either body member 1 or 2, as the case may be, and the body member not having the shafts has axially aligned openings spaced apart for receiving the shafts, it is to be understood that body members 1 and 2 may be shaped such that only one shaft and one opening for receiving the shaft are required to provide the rotatable attachment means and integral biasing means following within the scope of this invention. One form of a non-symmetrical embodiment of the clip of the invention, would be, for example, where body member 2 of FIG. 8B was divided into two parts along longitudinal axis C thereof and one of the parts, properly oriented, is rotatably attached to a body member 1 having means for securement to an electrical plug and cable assembly at one end thereof but, only one opening at the attachment means end, thereof for rotational attachment thereto and only one opening for restricting movement of the opposite end thereof.

Figure 9:
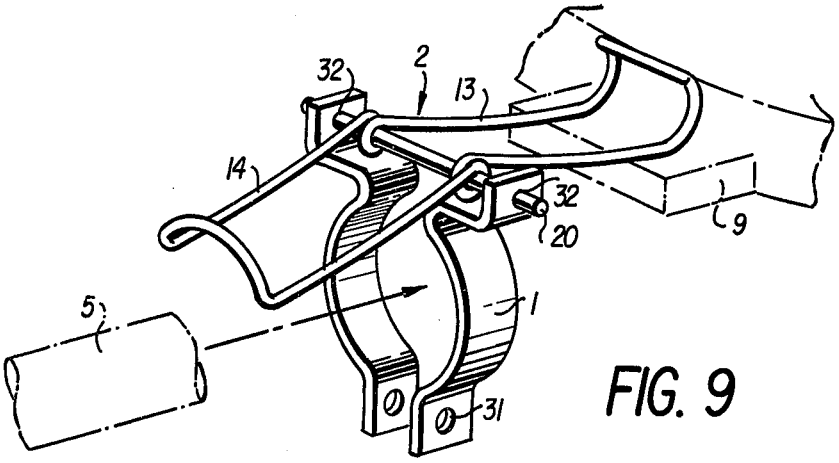
FIG. 9 is an exploded fragmentary view of an embodiment of the clip of the invention.

FIG. 9 shows an embodiment wherein body member 1 has two spaced apart parts shaped such that body member 1 can be clamped about electrical cable 5. Axially aligned opening 31 in each of the said parts may have a suitable bolt inserted therethrough such that the tightening thereof causes the two parts of body member 1 to press against cable 5 to provide the means of securing body member 1 thereto. Opening 32 is disposed in each of the parts at the opposite end of body member 1 such that they are axially aligned and suitably spaced apart for receiving shaft 20 when body member 1 is secured to cable 5. Shaft 20 in this embodiment is not integral with either body members 1 or 2 and extends through a pair of spaced apart axially aligned loops in body member 2 to provide the means of rotatably attaching body member 2 to body member 1. Adapted end 13 extends generally away from shaft 20 towards cover plate 9 and opposite end 14 extends away from shaft 20 in a direction generally away from cover plate 9 and is closed at the end thereof and is shaped such that it presses upon cable 5 to provide the integral biasing means for pressing adapted end 13 against the outer surface of cover plate 9. The example of the embodiment of the clip of this invention shown in FIG. 9 is for purposes of illustrating that body member 1 may comprise more than one part and that the rotatable attachment means between body members 1 and 2 may include parts thereof that are not integral therewith such as, for example, shaft 20 shown as FIG. 9.

Figure 10:
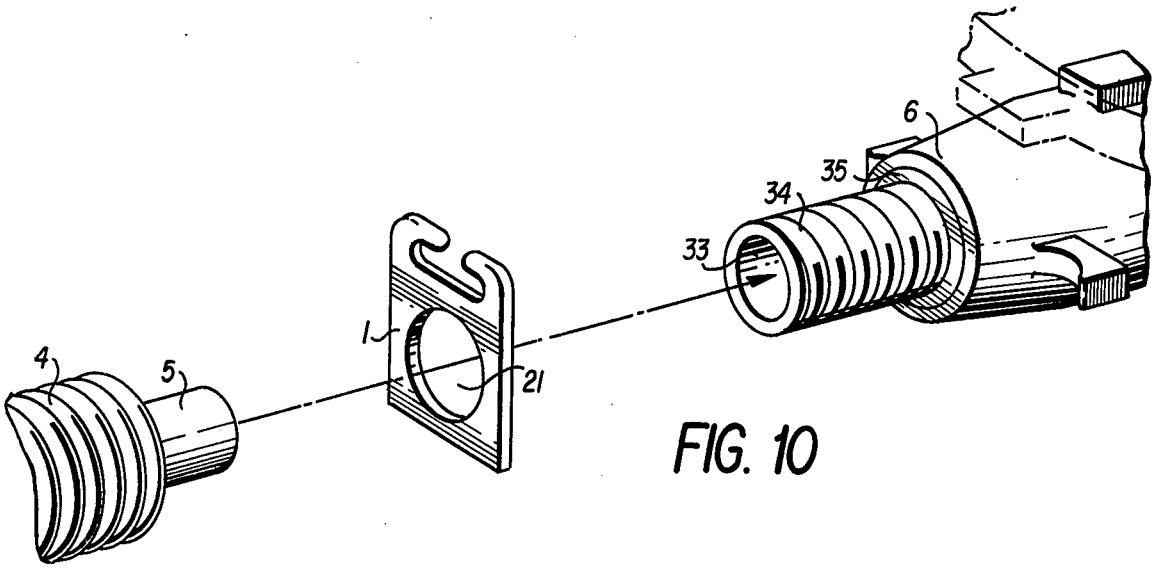
FIG. 10 is an exploded fragmentary view illustrating an embodiment of the means of securing the first body member of the clip of the invention to an electrical plug and cable assembly.

FIG. 10 shows a means of securing body member 1 of the clip of the invention to an electrical plug and cable assembly comprising electrical cable 5; protective armour 4 disposed about electrical cable 5; and plug 6. Body member 1 of FIG. 10 is in the form of a plate having opening 21 disposed at one end thereof and sized such that the end of electrical cable 5 having protective armour 4 disposed thereabout can be inserted therethrough. The end of cable 5 is inserted into opening 33 disposed at the end of plug 6 to make electrical connection therewith. Armour 4 is threaded onto external threads 35 disposed at the end of plug 6 such that body member 1 is pressed between the end of armour 4 adjacent the end of plug 6 and surface 35 which is disposed at the end of plug 6 and faces body member 1. Although in the embodiment shown in FIG. 10, protective armour 4 is preferrably made from a metallic wire, it is to be understood that the plug end may be threaded internally for such securement means and that armour 4 may be of any form that is capable of being threadingly attached to the end of plug 6. It is also to be understood that armour falling within the scope of this invention; may be of any suitable form; may be made from suitable metallic or polymeric materials; and is not required to be secured to the end of the electrical plug.

Figure 11:
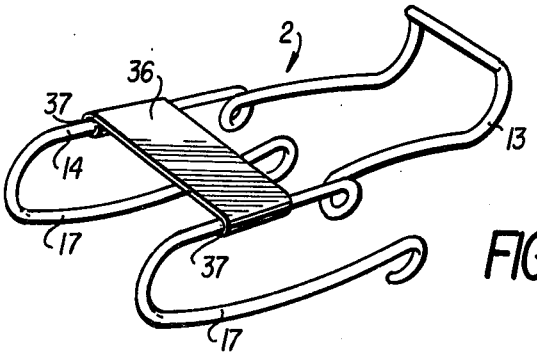
FIG. 11 is a perspective view of an embodiment of the second body member of the clip of the invention.

FIG. 11 shows an embodiment of the invention wherein spaced apart legs 17 of opposite end 14 of body member 2 are secured by means of bridging member 36. Although body member 2 may or may not be provided with a bridging means such as, for example, member 36, it is preferred, in many cases, to provide such bridging means in various embodiments of the clip of the invention. In the example shown in FIG. 11, member 36 is in the form of a plate that secures legs 17 in a spaced apart relationship by folding and compressing member 36 about legs 17 at points 37. Such bridging means can be used to advantage, for example, in providing a surface upon which one may press to cause rotation of body member 2 about body member 1 to cause adapted end 13 of body member 2 to move away from the receptacle cover plate in order to remove the electrical plug and cable assembly from the electrical receptacle. Such bridging means can also be used to advantage where it is desired to maintain a fixed distance between legs 17 of opposite end 14 such that, for example, body member 2 of FIG. 11 may be attached to the embodiment A of body member 1 shown in FIG. 5 whereby attachment of such bridging means prevents legs 17 from springing apart and disengaging body member 2 of FIG. 11 from body member 1 of FIG. 5A. It is to be understood that bridging member 36 shown in FIG. 11 is for illustration purpose only and that such bridging means are included within the scope of the invention; may have any suitable shape; may be made from any suitable material; and, dependent upon design, may be fixedly or releasably attached to body member 2 before or after body member 2 is rotatably attached to body member 1 to provide an embodiment of the clip of the invention.

Although the clip of the invention herein described is preferrably made by forming it from a plate or a wire, it is to be understood that any form may be suitable which provides a particular characteristic desired. Body members 1 and 2 may be a combination of plate and wire or either alone or other forms or combinations thereof found to be suitable. Although body members 1 and 2 may be made from polymeric materials, it is preferred that they be made from a metal having the particular rigidity or resilience required for the application. Depending upon the materials selected, body members 1 and 2 may or may not have the same resiliency and may in fact be combinations of polymeric and metallic materials.

As hereinbefore described, it is not required that body members 1 and 2 have spaced-apart symmetrical parts transverse to the longitudinal axis of the electrical plug and cable assembly nor is it required that the means of rotatable attachment between body members 1 and 2 consist entirely of portions integral to both. Although body members 1 and 2 are preferrably formed from a single wire and/or plate, as the case may be, they may be comprised of two or more parts such as, for example, the two parts of body member 1 shown in FIG. 9.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A clip for securing an electrical plug and cable assembly in an electrical receptacle having a hinged cover plate and adapted to form an electrical connection with the plug, said clip having a first body member having means disposed at one end thereof for securement to the electrical plug and cable assembly and means disposed at the opposite end thereof for rotatable attachment to rotatable attachment means disposed in a second body member between an opposite end thereof and an end adapted to press upon the outside surface of the receptacle cover plate when the first body member is secured to the electrical plug and cable assembly, and means integral with the second body member for biasing the said adapted end of the second body member towards the cover plate outer surface and press it towards a closed position such that at least a portion of the inside surface of the cover plate presses against the plug and secures the electrical plug and cable assembly against relative movement with the receptacle, said integral biasing means comprising the opposite end of the second body member having a shape such that a portion thereof is caused to press against a fixed surface of the electrical plug and cable assembly when the cover plate is moved away from the plug and cable assembly towards an open position and resist rotation of the second body member with respect to the first body member and bias the adapted end thereof towards the cover plate to return it towards a closed position.

2. The clip of claim 1 wherein the fixed surface is an exposed surface of the plug.

3. The clip of claim 1 wherein the exposed surface is a portion of the cable adjacent the end of the plug from which the cable extends.

4. An electrical connector assembly comprising a receptacle mounted on a trailer of a tractor-trailer vehicle, an electrical plug and cable assembly connected to a source of electricity on the tractor and having the plug inserted in the receptacle and making electrical contact therewith, an exposed protuberant member on the plug, a cover hinged to the receptacle having a protuberance extending away from the inner surface thereof, a clip having a first body member secured at one end thereof to the plug and cable assembly and rotatably attached at the opposite end thereof to rotatable attachment means disposed on a second body member between an opposite end thereof and having an end shaped to press against a fixed surface of the electrical plug and cable assembly when the receptacle cover plate is moved away from the plug and cable assembly towards an open position and resist rotation of the said second body member whereby a portion of the protuberant member extending from the inner surface of the cover plate presses against an exposed surface of the protuberant member on the plug to secure the plug and cable assembly against relative movement with the receptacle.

5. An electrical connector assembly comprising an electrical receptacle, an electrical plug and cable assembly having one end of the plug inserted in the receptacle and making electrical contact therewith, a cover plate hinged to the receptacle and biased towards the plug and cable assembly, a clip having a first body member secured at one end thereof to the plug and cable assembly and rotatably attached at the opposite end thereof to rotatable attachment means disposed in a second body member between an opposite end thereof and an end adapted to press upon the outside surface of the receptacle cover plate, and means integral with the first or second body member for biasing the said adapted end of the second body member towards the cover plate outer surface and press it towards a closed position such that a portion of the inside surface of the cover plate presses against the plug and secures the plug and cable assembly against relative movement with the receptacle, said opposite end of said second body member having a shape such that a portion thereof is caused to press against a fixed surface of the electrical plug and cable assembly when the cover plate is moved away from the plug and cable assembly towards an open position and resists rotation of the second body member with respect to the first body member and bias the adapted end thereof towards the cover plate to return it towards a closed position.

6. The clip of claim 5 wherein the means for interlocking the first and second body member comprises restricting means spaced apart from the first body member rotational attachment means and the said opposite end of the second body member is shaped such that a portion thereof presses against the restricting means when the cover plate is moved away from the plug and cable assembly towards an open position and the reaction force resulting therefrom causes increased friction between the first and second body member rotational attachment means to resist the relative rotation therebetween and bias the adapted end of the second body member towards the outer surface of the cover plate to return it towards a closed position.

7. The electrical connector assembly of claim 5 wherein the fixed surface is an exposed surface of the plug.

8. The electrical connector assembly of claim 5 wherein the exposed surface is a portion of the cable adjacent the end of the plug from which the cable extends.

9. The electrical connector assembly of claim 5 wherein the means for interlocking the first and second body members comprises restricting means spaced apart from the first body member rotational attachment means and the said opposite end of the second body member is shaped such that a portion thereof presses against the restricting means when the cover plate is moved away from the plug and cable assembly towards an open position and the reaction force resulting therefrom causes increased friction between the first and second body member rotational attachment means to resist relative rotation therebetween and bias the adapted end of the second body member towards the outer surface of the cover plate to return it towards a closed position.

* * * * *